US009655456B2

(12) United States Patent
Boyd et al.

(10) Patent No.: US 9,655,456 B2
(45) Date of Patent: May 23, 2017

(54) MATTRESS

(71) Applicants: Dennis M. Boyd, St. Louis, MO (US); Carla Williams, St. Louis, MO (US)

(72) Inventors: Dennis M. Boyd, St. Louis, MO (US); Carla Williams, St. Louis, MO (US)

( * ) Notice: Subject to any disclaimer, the term of this patent is extended or adjusted under 35 U.S.C. 154(b) by 95 days.

(21) Appl. No.: 14/309,885

(22) Filed: Jun. 19, 2014

(65) Prior Publication Data

US 2015/0015402 A1 Jan. 15, 2015

Related U.S. Application Data

(60) Provisional application No. 61/837,243, filed on Jun. 20, 2013.

(51) Int. Cl.

| | |
|---|---|
| ***A47C 27/10*** | (2006.01) |
| ***A47C 27/08*** | (2006.01) |
| ***A47C 27/15*** | (2006.01) |
| ***A47D 1/00*** | (2006.01) |

(52) U.S. Cl.

CPC ..... *A47C 27/10* (2013.01); *A47C 27/085* (2013.01); *A47C 27/088* (2013.01); *A47C 27/15* (2013.01); *A47D 1/006* (2013.01)

(58) Field of Classification Search

CPC ... A47C 27/085; A47C 27/088; A47C 27/081; A47C 27/144; A47C 31/123; A47C 27/083; A47C 27/128; A47C 27/18; A47C 27/08

USPC ..... 340/626, 625, 575, 573.1; 5/618, 600, 5/616, 613

See application file for complete search history.

(56) References Cited

U.S. PATENT DOCUMENTS

| | | | | |
|---|---|---|---|---|
| 5,787,531 | A * | 8/1998 | Pepe | A47C 27/10 5/710 |
| 6,413,458 | B1 * | 7/2002 | Pearce | A43B 13/04 264/141 |
| 6,691,355 | B1 * | 2/2004 | Liu | A61G 7/05715 5/655.5 |
| 7,086,104 | B1 * | 8/2006 | Tsay | A61G 7/05776 5/655.3 |
| 2001/0034908 | A1 * | 11/2001 | Daly | A61G 7/05776 5/713 |
| 2005/0125905 | A1 * | 6/2005 | Wilkinson | A47C 27/082 5/713 |
| 2007/0214571 | A1 * | 9/2007 | Piraino | A47C 7/462 5/616 |
| 2008/0289108 | A1 * | 11/2008 | Menkedick | A61G 7/005 5/610 |
| 2013/0000047 | A1 * | 1/2013 | McCann | A47C 27/082 5/709 |

* cited by examiner

*Primary Examiner* — Mirza Alam

(74) *Attorney, Agent, or Firm* — Harness, Dickey & Pierce, P.L.C.

(57) ABSTRACT

A mattress includes a generally rectangular prismatic foam body, having a length, a width, and a thickness, having a top surface, a plurality of slits in the top surface of the foam body extending across the width of the body to divide the top surface into a plurality of adjacent slats. An elongate chamber extends through the body, parallel to and aligned with each slit. At least one fluid filled cell disposed in each of the elongate chambers to support the edges of adjacent slats.

20 Claims, 6 Drawing Sheets

MATTRESS

CROSS-REFERENCE TO RELATED APPLICATIONS

This Utility Patent Application claims priority to U.S. Provisional Application No. 61/837,243, filed Jun. 20, 2013, the disclosure which is incorporated herein.

FIELD

The present disclosure relates to mattresses, and in particular to hybrid foam mattresses with adjustable properties.

BACKGROUND

This section provides background information related to the present disclosure which is not necessarily prior art.

Early matters consisted of a cloth case containing a soft material, such as straw, feathers, or horse hair. In 20$^{th}$ century mattresses typically comprised an innerspring core surrounded with cotton batting or fiberfill. More recent developments include fluid filled mattresses, such as water beds and air mattresses, and foam mattresses, such as latex, viscoelastic or other flexible polyurethane foams. Each of these materials has relative advantages and disadvantages in terms of comfort, support, conformability, isolation, air circulation, and temperature, and various hybrid constructions have been developed to combine their advantages and limit the disadvantages.

Examples of these hybrid mattresses include Daley, U.S. Application No. 2001/0034908, Sampson, U.S. Pat. No. 2,069,422; Mattison, U.S. Pat. No. 2,192,601; Perry, U.S. Pat. No. 2,345,421; Rockoff, U.S. Pat. No. 2,748,399; Holliday, U.S. Pat. No. 4,042,988; Harper, U.S. Pat. No. 4,829,614; Sereboff, U.S. Pat. No. 5,303,977; Purdy et al., Calalway et al., U.S. Pat. No. 5,353,454; U.S. Pat. No. 5,680,662; Higgs, U.S. Pat. No. 5,249,319; Stolpmann et al., U.S. Pat. No. 6,212,718; Jansen, U.S. Pat. No. 7,444,703; Tsay, U.S. Pat. No. 7,086,104; and Brykalski, U.S. Pat. No. 8,418,286.

SUMMARY

This section provides a general summary of the disclosure, and is not a comprehensive disclosure of its full scope or all of its features.

Various embodiments of this invention provide a mattress for a bed. According to one preferred embodiment this mattress comprises a foam body having a top surface. Preferably, there are a plurality of slits extending across the top surface of the foam body to divide the top surface into a plurality of adjacent slats. There is preferably at least one elongate chamber extending through the body, generally parallel to and generally aligned with each slit. At least one filled-cell is disposed in at least one of the elongate chambers to support at least one slat.

The foam body is preferably a rectangular prism having a length, a width, and a thickness. The slits preferably extend across the width of the foam body, dividing the top surface into a plurality of adjacent slats across the length of the foam body. Alternatively the slits could extend across the length of the foam body, dividing the top surface into a plurality of adjacent slats across the width of the foam body.

The fluid filled cells preferably each comprise an elongate flexible envelope, with a recloseable opening for adding fluid to the envelope. The fluid-filled cells can contain gas (such as air), liquid (such as water), gel, and/or foam. The fluid-filled cells preferably have specified firmness fill levels indicated on the exterior of the envelope. There is preferably at least one fluid cell in each chamber, but there could be two or more. The fluid-filled cells can have different fluid fill levels, providing different levels of support of the mattress surface. The fluid-filled cells can have the same or a different cross sectional shape than the chamber in which they are disposed.

The elongate chambers can have a generally circular cross-section; alternatively they can have a generally rectangular cross-section, or a generally oval cross-section. When the chamber has a generally oval cross section, it can be oriented with the major axis generally parallel to the top surface, or alternatively with the minor axis generally parallel to the top surface.

A foam sheet can overlie the top surface of the body, and/or a cover can extend over at least the top surface of the mattress.

The foam body preferably comprises polyurethane foam, with a density of between about 0.5 and about 7.0 pounds per ft$^3$, and a firmness of between about 8 IFD and about 70 IFD, as measured according to ASTM D3574.

The elongate chambers preferably extend under the ends of adjacent slats so that each slat has generally T-shaped configuration, connected to the body at the stem of the T, with the arms extending oppositely to adjacent slits, with an elongate chamber on each side of the stem underneath each arm. In the preferred embodiment the slits are equally spaced to divide the top surface of the body into slats of equal size, although in some embodiments the slits could be unequally spaced to divide the top surface of the mattress into slats of unequal size. In the preferred embodiment there are seven slits defining six slats between them, but there could be fewer or more slits if desired.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
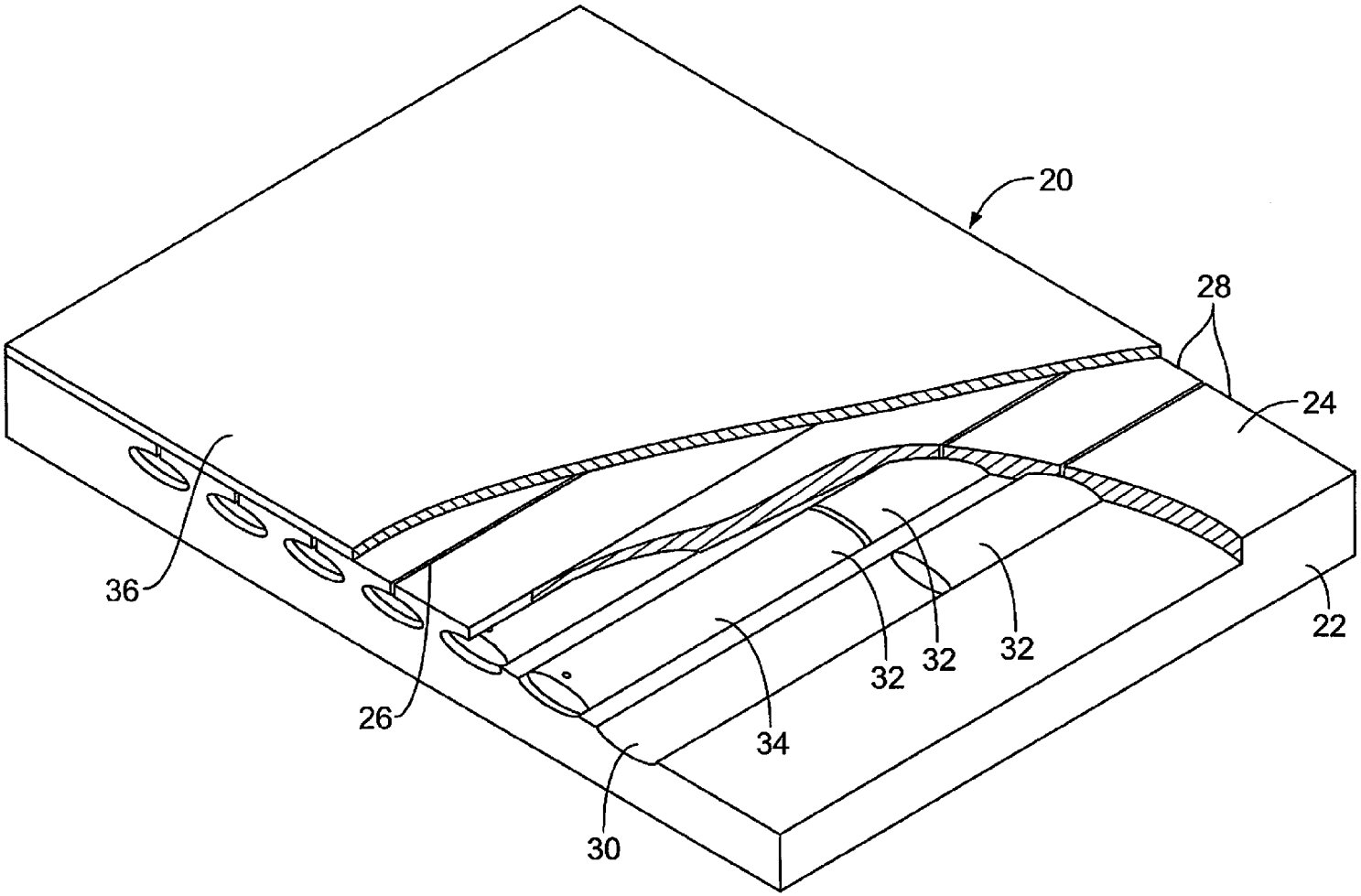
FIG. 1 is a schematic diagram of a preferred embodiment of a mattress constructed in accordance with the principles of this invention.

A preferred embodiment of a mattress in accordance with the principles of this invention is indicated generally as 20 in FIG. 1. The mattress 20 is adapted for use on a box spring or other conventional bed support, to provide comfortable support of a person while resting or sleeping. According to the preferred embodiment shown in the Figures and described herein, this mattress 20 comprises a foam body 22 having a top surface 24. There are preferably a plurality of slits 26 extending across the top surface 24 of the foam body 22 that divide the top surface into a plurality of adjacent slats 28. There is preferably at least one elongate chamber 30 extending through the body 22, generally parallel to and generally aligned with each slit 26. At least one filled-cell 32 is disposed in at least one of the elongate chambers 30 to support at least one slat 28.

Figure 2:
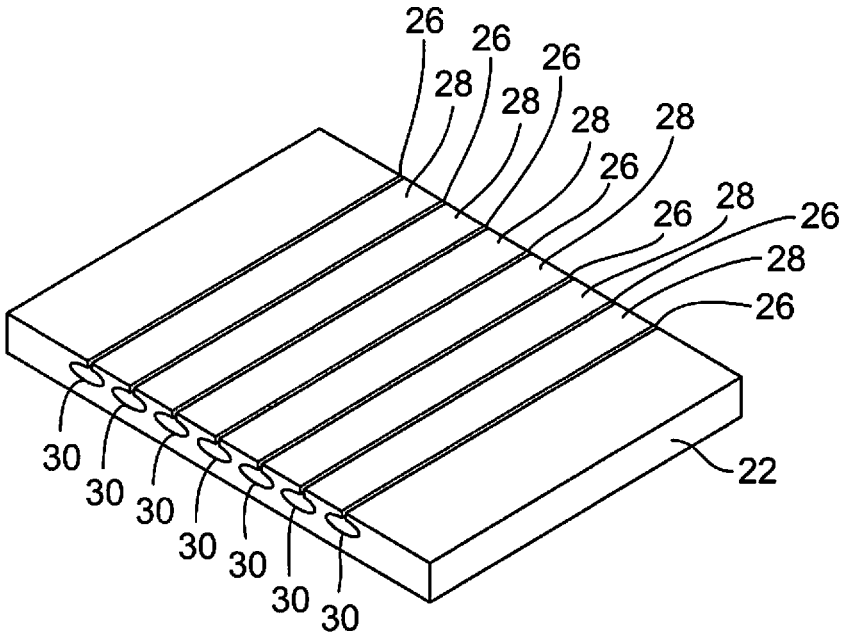
FIG. 2 is a perspective view of a foam body comprising part of the mattress of the preferred embodiment.
Figure 3:
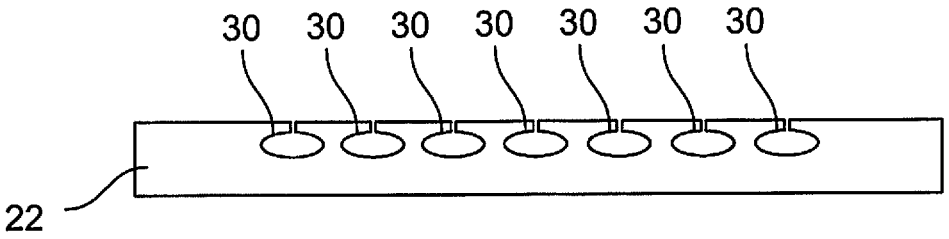
FIG. 3 is a side elevation view of the foam body.
Figure 4:
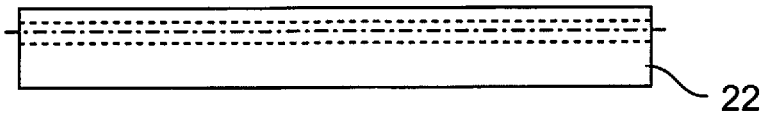
FIG. 4 is an end elevation view of the foam body.
Figure 5:
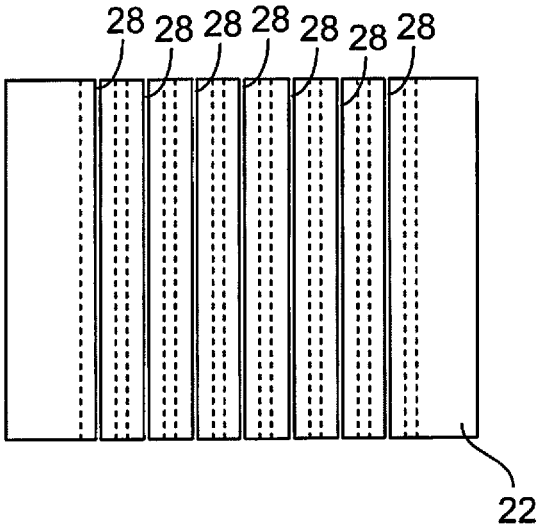
FIG. 5 is a top plan view of the foam body.

As shown in FIGS. 1 and 2, the foam body 22 is preferably a rectangular prism having a length, a width, and a thickness. The foam body 22 could of course be some other shape, such as disc shaped if desired. The slits 26 preferably extend across the width of the foam body, dividing the top surface 24 into a plurality of adjacent slats 28 across the length of the foam body 22. Alternatively the slits could extend across the length of the foam body, dividing the top surface into a plurality of adjacent slats across the width of the foam body.

The fluid filled cells 32 preferably each comprise an elongate flexible envelope 34, with a recloseable opening (not shown) for adding fluid to the envelope. The fluid-filled cells 32 can contain gas (e.g., air), liquid (e.g., water), gel, foam, and or particles. Suitable gels can have a wide range of properties, including rheological properties heat absorption and heat conduction properties. Similarly, suitable foams can have a wide range of properties, and can include polyurethane foams, latex foams, and viscoelastic foams (so-called "memory foams"), of various densities and IFD. The flexible envelopes 34 preferably have indicia 36 indicating firmness fill levels. There is preferably at least one fluid-filled cell 32 in each chamber 30, but there could be two or more cells in a chamber. The fluid-filled cells 22 can have different fluid fill levels, to selectively provide different levels of support for the overlying slats 28 comprising the mattress surface 24. The fluid-filled cells 22 preferably having the same size and shape cross section as the chambers 30 in which they are disposed.

The preferred oval shape of the fluid-filled cells 22 provides a significant portion of the "sub surface" of the mattress to consist of consist of the fluid filled cells. Preferably the cells underlie at least 50% of the subsurface, and in the preferred embodiment underlie about 78% of center portion of the mattress. This helps provide excellent contouring capabilities, particularly under the hip and torso area. By providing fluid-filled cells 20 with a greater horizontal axis greater than vertical axis, the fluid filled cells 22 can comprise a larger portion of the subsurface area without much corresponding weight (when using heavier content fill such as water or gel). This allows for a superior contouring effect without unduly burdening the mattress with excess weight.

The elongate chambers 30 preferably have a generally oval cross section, but they could have a circular or rectangular cross-section as well. The oval cross section of the chamber 30 can be oriented the major axis generally parallel to the top surface 24 of the body 22, or alternatively with the minor axis generally parallel to the top surface. The chamber can open at each end to the sidewall of the body 22. Alternatively one or both ends of the chambers 30 can be closed.

A foam sheet 36 can overly the top surface of the body, and/or a cover (not shown) can extend over at least the top surface of the mattress 20.

Figure 6:
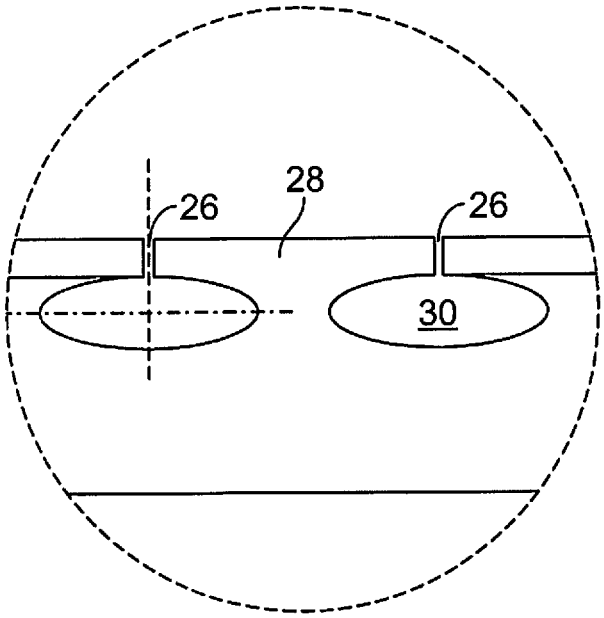
FIG. 6 is an enlarged partial side elevation view of the foam body, showing the slits and the chambers.

The foam body 22 preferably comprises polyurethane foam, but could also be latex foam, gel-filled foams, and various viscoelastic foams (so-called "memory foams". The foam preferably has a density of between about 0.5 and about 7.0 pounds per $ft^3$, and a firmness of between about 8 IFD and about 70 IFD, as measured according to ASTM D3574. The foam body is preferably a single block of a single material with uniform properties; however the foam body could comprise multiple sections of the same foam with the same properties, the same foam with different properties, or different foams with different properties. These sections could be different layers, or different blocks arranged across the width or length to provide different support As best shown in FIG. 6, the elongate chambers 30 preferably extend under the ends of adjacent slats 28 so that each slat has generally T-shaped configuration, connected to the body at the stem of the "T", with the arms of the "T" extending oppositely to adjacent slits. An elongate chamber 30 is disposed on each side of the stem underneath each arm.

In the preferred embodiment the slits 26 are equally spaced to divide the top surface 24 of the body into slats 28 of equal size, although in some embodiments the slits could be unequally spaced to divide the top surface of the mattress into slats of unequal size. In the preferred embodiment there are seven slits defining six slats between them, but there could be fewer or more slits if desired.

In the preferred embodiment, the thickness of each the arms of the generally T-shaped slat tapers from the stem to the end of the arm. The minimum thickness of the stem of the T is less than the distance from the stem to the end of each arm. The width of the cross section of the elongate chamber is less that the width of the T forming the slat. Adjacent elongate chambers underlie at least about 50% of the width of the T forming the slat, but preferably underlie no more than about 75% of the width of the T forming the slat. The minimum thickness of the stem of the T equals the distance from the top surface to the depth where the minimum thickness occurs.

The T-shaped configuration of the slats 28 allows for improved contouring as each foam T structure is allowed to individually articulate/rotate from the head to the foot of the mattress. In some embodiments some or all of the T-shaped slats 28 may be cut into two or more segments to form multiple independently articulating units. For example in some embodiments the slats 28 might be bisected so that the slats on one side of the mattress respond independently of the slats on the other side of the bed. In other embodiments some of the slats may be bisected, for example the slats in the middle portion of the mattress to provide selected areas of independent responsiveness. Of course in still other embodiments some or all of the slats could be divided into more than two segments. In embodiments where the slates are divided into two or more sections, it is generally desirable, but not required, that separate fluid-filled cells 22 be provided in the chambers corresponding to and aligned with each segment. This further enhances the independent action of the slat segments.

The elongate chambers 30 are disposed within the upper half of the thickness of the foam body 22. The width of the cross-section of the elongate chamber is preferably at least two times the height of the cross-section of the elongate chamber, and more preferably at least three times the height of the cross-section of the elongate chamber.

The thickness of the arms at their ends is preferably at least one half of the thickness at the stem. The thickness of the arms at their ends is at least one half of the height of the cross-section of the elongate chamber. The minimum thickness of the stem of the T is preferably less than one third of the width of the top of the T forming the slat.

Table 1 shows the dimensions of the preferred embodiment, although these dimensions can be changed to adjust the properties of the mattress.

| Description | Symbol | Dimension |
|---|---|---|
| Thickness of body | A | 7 inches |
| Height of chamber | B | 2 inches |
| Depth of chamber | C | 1 inch |
| Width of chamber | D | 6 inches |
| Separation of Chambers | E | 2 inches |
| Width of the "T" | F | 7.75 inches |
| Width of the slot | G | 0.25 inches |
| Distance from bottom of chamber to top of Body | H | 3 inches |
| Distance from the bottom of the chamber to the bottom of the body | I | 4 inches |
| Distance from the top of the chamber to the bottom of the body | J | 6 inches |
| Distance from the midpoint of the chamber to the top | K | 2 inches |
| Distance from the center of the chamber to the end | L | 3 inches |

Figure 7:
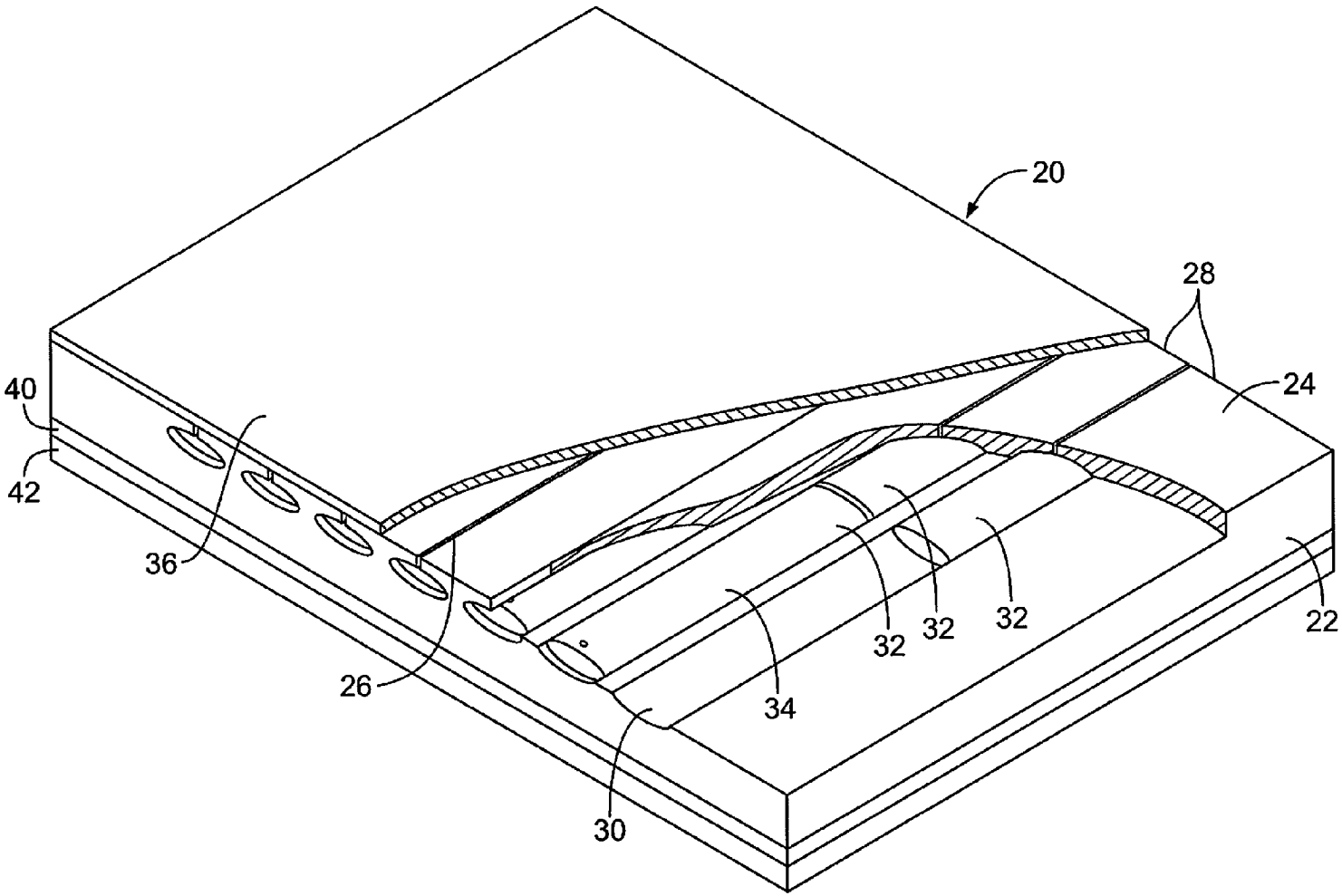
FIG. 7 is a schematic diagram of an alternate construction of the preferred embodiment.

An first alternate construction of the preferred embodiment of a mattress is indicated generally as 20' in FIG. 7. Mattress 20' is similar to mattress 20, and corresponding parts are identified with corresponding numbers. However mattress 20' further includes additional substrates (support layers) 40 and 42. The layer 40 is preferably made of a material, such as a foam, or polystrand material, with a higher IFD (indentation force deflection) or firmness than the rest of the mattress. The layer 42 below the layer 40, is preferably made of a material, such as a foam or polystrand material, with an even higher IFD or firmness than layer 40.

Figure 8:
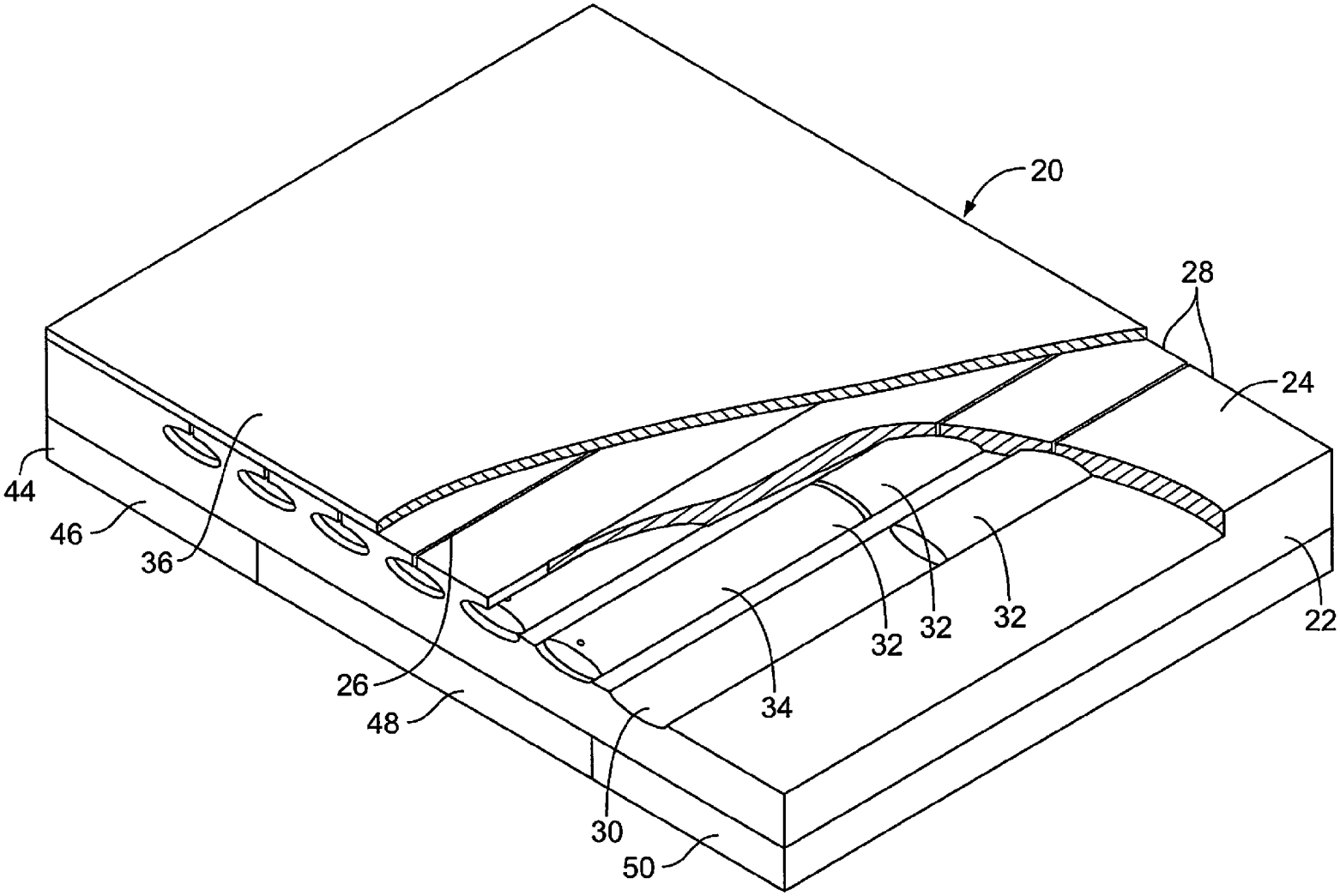
FIG. 8 is a schematic diagram of a second alternate construction of the preferred embodiment.

A second alternate construction of the preferred embodiment of a mattress is indicated generally as 20" in FIG. 8. Mattress 20" is similar to mattress 20, and corresponding parts are identified with corresponding numbers. However mattress 20" further includes an additional substrate layer 44. The layer 44 preferably comprises two or more segments. As shown in FIG. 8, the layer 44 comprises sections 46, 48, and 50. Each of the sections is preferable made of a material, such as a foam or a polystrand material, with an appropriate IFD or firmness. For example, section 48 underlying the central portion of the mattress, can have a higher IFD or firmness than sections 46 and 50 underlying the head and foot of the mattress. Sections 46 and 50 can have the same IFD or firmness, or they can have a different IFD or stiffness. While three sections 46, 48, and 50 are shown in FIG. 8, there could be fewer or more sections.

Figure 9:
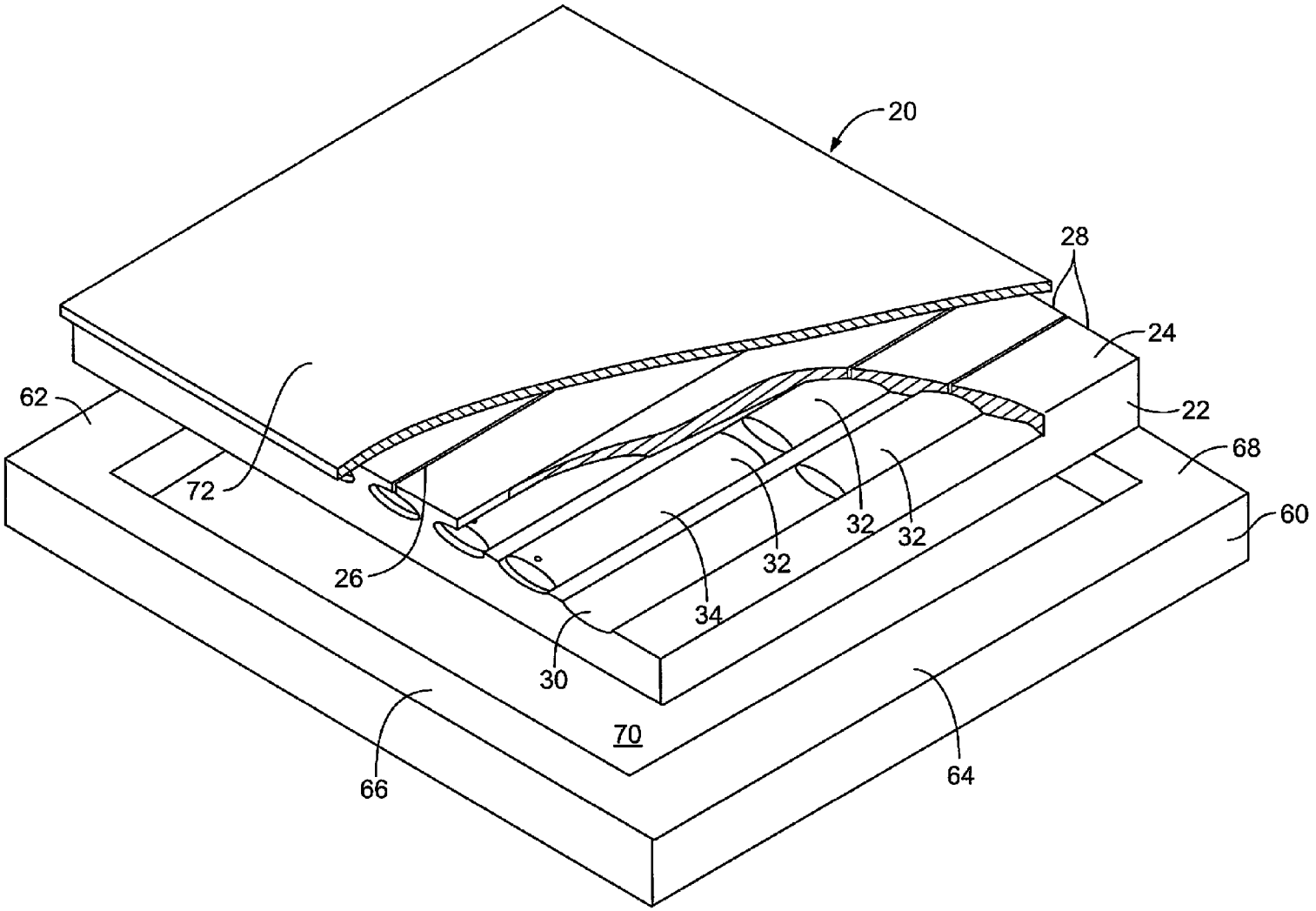
FIG. 9 is a schematic diagram of a third alternate construction of the preferred embodiment.

A third alternate construction of the embodiment of a mattress is shown in FIG. 9. As shown in FIG. 9, a mattress according to the principles of the invention, such as mattress 20, 20', or 20" is installed in a tray 60. The tray 60 comprises a base with a head wall 62, a foot wall 64, and left and right side walls 66 and 68 that define a generally central recess 70 for receive the mattress 20, 20' or 20". The tray 60 can be made of a foam, preferably with a higher IFD or firmness than the mattress so to form a firm edge to facilitate getting into and out of the bed. A comfort layer 72, instead of or in addition to the foam layer 36, can be provided, sized the same as the mattress, and central recess 70 can be made to accommodate both the mattress and the comfort layer. Preferably, however, the comfort layer 72 is sized to overly both the mattress and the tray 60. The comfort layer 72 can also be made of a foam.

The tray helps keep the mattress assembled and protects its components. It can also contain any fluid that leaks from the mattress. The tray 60 can be made of any suitable material including foam, and may be of a closed cell foam or a coated foam to make the tray fluid tight. The tray can be made of a flame resistant material, or coated with a flame resistant material to assist in passing the Consumer Products Safety Commission regulation 1633 mattress flammability test.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A mattress for a bed comprising:

a foam body having a top surface;

a plurality of slits extending across the top surface of the foam body to divide the top surface into a plurality of adjacent slats;

an elongate chamber extending through the body, parallel to and aligned with each slit wherein the elongate chambers extend under ends of adjacent slats so that each slat has generally T-shaped configuration, connected to the body at stem of the T, with arms extending oppositely to adjacent slits, and an elongate chamber on each side of the stem underneath each arm, thickness of each the arms of the generally T-shaped slat tapering from the stem to the end of the arm, and minimum thickness of the stem of the T is less than distance from the stem to the end of each arm; and at least one fluid filled cell disposed in at least one of the elongate chambers to support at least one slat.

2. The mattress according to claim 1 wherein the foam body is a rectangular prism having a length, a width, and a thickness.

3. The mattress according to claim 2 wherein the slits extend across the width of the foam body, dividing the top surface into a plurality of adjacent slats across the length of the foam body.

4. The mattress according to claim 2 wherein the slits extend across the length of the foam body, dividing the top surface into a plurality of adjacent slats across the width of the foam body.

5. The mattress according to claim 1 wherein each fluid-filled cell comprises a flexible envelope, with a recloseable opening for adding fluid to the envelope.

6. The mattress according to claim 1 wherein the elongate chambers have a generally circular cross-section.

7. The mattress according to claim 1 wherein the elongate chambers have a generally rectangular cross-section.

8. The mattress according to claim 1 wherein the elongate chambers have a generally oval cross-section.

9. The mattress according to claim 8 wherein the oval cross-section of the elongate chambers has a major axis and a minor axis, and is oriented with the major axis generally parallel to the top surface.

10. The mattress according to claim 8 wherein the oval cross-section of the elongate chambers has a major axis and a minor axis, and is oriented with the minor axis generally parallel to the top surface.

11. The mattress according to claim 1 wherein there are at least two fluid-filled cells with different fluid fill levels.

12. The mattress according to claim 1 wherein there is at least one fluid-filled cell in each elongate chamber.

13. The mattress according to claim 12 wherein there are at least two fluid-filled cells in each elongate chamber, providing differential support of the slats on each side of the mattress.

14. The mattress according to claim 1 further comprising a foam sheet overlying the top surface of the body.

15. The mattress according to claim 1 further comprising a cover extending over at least the top surface of the mattress.

16. The mattress according to claim 1 wherein the foam body comprises polyurethane foam.

17. The mattress according to claim 1 wherein at least some of the fluid-filled cells contain gas.

18. The mattress according to claim 1 wherein at least some of the fluid-filled cells contain liquid.

19. The mattress according to claim 1 wherein adjacent elongate chambers underlie at least about 50% of width of the T forming the slat.

20. The mattress according to claim 1 wherein adjacent elongate chambers underlie no more than about 75% of width of the T forming the slat.

* * * * *